US005871204A

United States Patent [19]

Spirer

[11] Patent Number: 5,871,204

[45] Date of Patent: Feb. 16, 1999

[54] HAND TOOL WITH ADJUSTABLE HEAD

[76] Inventor: Steven E. Spirer, 391 Haworth Ave., Haworth, N.J. 07641

[21] Appl. No.: 758,352

[22] Filed: Dec. 3, 1996

Related U.S. Application Data

[60] Provisional application No. 60/009,645 Dec. 4, 1995.

[51] Int. Cl.[6] ..... B25C 11/00

[52] U.S. Cl. ..... 254/26 R; 254/27; 254/31; 81/177.8; 81/22

[58] Field of Search ..... 254/26 R, 26 E, 254/27, 28, 21, 23, 19, 25, 18, 17, 131; 81/22, 20, 177.8, 177.9

[56] References Cited

U.S. PATENT DOCUMENTS

| | | | |
|---|---|---|---|
| D. 237,582 | 11/1975 | Mostyn . | |
| D. 322,021 | 12/1991 | Hsu . | |
| D. 325,863 | 5/1992 | Chen . | |
| 691,309 | 1/1902 | Goldsmith . | |
| 1,709,240 | 4/1929 | Wass | 254/25 |
| 2,325,227 | 7/1943 | Chaddock | 254/25 |
| 2,804,109 | 8/1957 | Fatica . | |
| 3,901,297 | 8/1975 | Young | 81/20 |
| 4,399,978 | 8/1983 | Moore | 254/26 R |
| 4,422,620 | 12/1983 | Nitzberg | 254/26 E |
| 4,440,206 | 4/1984 | Dart . | |
| 4,805,494 | 2/1989 | Santoro . | |
| 4,998,996 | 3/1991 | Belanger | 254/26 E |
| 5,029,496 | 7/1991 | Catania | 81/22 |
| 5,058,862 | 10/1991 | Schlegel . | |
| 5,280,738 | 1/1994 | Liou | 81/20 |
| 5,329,834 | 7/1994 | Wong | 81/177.8 |
| 5,372,053 | 12/1994 | Lee | 81/22 |

*Primary Examiner*—James G. Smith
*Assistant Examiner*—Lee Wilson
*Attorney, Agent, or Firm*—Weingram & Associates, P.C.

[57] ABSTRACT

A hand tool with a pivotal head portion includes a first manually rotatable collar which causes movement of a second slidable collar along a handle of the tool to secure the head portion at a desired angle with respect to the handle. Serrations on the tool head and slidable collar releasably engage each other to lock the head at the desired angle. The tool head is mounted on the handle using either ball and socket or tongue and groove configurations.

19 Claims, 6 Drawing Sheets

HAND TOOL WITH ADJUSTABLE HEAD

BACKGROUND OF THE INVENTION

1. Cross-Reference to Related Applications

This application claims the benefit of U.S. Provisional Application No. 60/009,645, filed Dec. 4, 1995.

2. Field of the Invention

The present invention relates to hammers, pry bars, and similar tools which have an adjustable head portion constructed to be positioned at a selected angle to enhance the striking power and purchase of the tool and particularly, to fully utilize the swing of the user, and to align the head portion to directly and accurately strike or grasp the object to be worked.

3. Description of the Prior Art

U.S. Pat. No. 2,804,109 to Fatica discloses a combination axe and adz with adjustable blade which includes a rack that coacts to move the angle of the head. Adjustment of the head is accomplished by unscrewing a poll to coact with a rack on the handle.

U.S. Pat. No. 4,399,978 to Moore discloses a hand tool with a variable inclined head consisting of a shaft extending from the butt of the handle through to the head and having a threaded portion proximate to the head to be threaded into position to secure the head in the desired angled position.

U.S. Pat. No. 5,280,738 to Liou discloses a hammer which includes a handle having two projections extending from one end thereof for receiving the head of the handle therebetween for pivotal movement. A lever arm and spring mechanism releasably engages the head for pivotal adjustment to a desired angle.

U.S. Pat. Nos. 3,935,889 to Derbyshire, and 5,058,862 to Schlegel disclose other adjustable tools.

U.S. Pat. Nos. 1,001,962 to Landes; 1,782,506 to Henderson; and 3,275,299 to Meshew, disclose hand tools each of which has a head portion with a wheel to drag the tool and the object being supported along an underlying surface.

OBJECTS AND SUMMARY OF THE INVENTION

The hammer with an improved head of the present invention provides for many advantages not obtainable from the structure of the known related tools.

It is an object of the present invention to provide a tool with an improved head portion, which head portion serves as a hammer, sledge hammer, axe, pick axe, pry bar or the like, which is constructed to be moveable with respect to a shaft of the tool.

It is another object of the present invention to provide a tool with an improved head portion that is adjustable through a range of angles with respect to a shaft of the tool to increase the mechanical advantage of the user's swing and to insure true contact with the object to be struck.

It is another object of the present invention to provide a hammer with an improved head portion which is adjustable to compensate for the angle of the head with respect to the hammer shaft so that the arc of the swing of the hammer permits the head to strike flush with an object.

It is another object of the present invention to provide a hammer with an improved head portion which has claws which are of a length sufficient to provide the necessary clearance for dislodging and removing an object in a restricted space.

It is another object of the present invention to provide an improved head for a hammer, which head is constructed with a plurality of shock absorbers to cushion the shock during hammer blows and to provide for a secure operable seating of the hammer head with the shaft.

It is another object of the present invention to provide a quick-release bayonet mounting for securing the improved head with the shaft.

It is another object of the present invention to provide a hammer with a shaft having an open ended bore extending therein for receipt of an object so that mechanical purchase on the object can be increased.

The present invention is a hand tool with a head portion and a handle attached to said head portion, the improvement consisting of: adjusting means for allowing said head portion to assume different angles with respect to the longitudinal axis of said handle, said adjusting means including slidable collar means slidably mounted to said handle and moveable between a first position and a second position for locking and unlocking said head portion in position, and rotatable collar means rotatably mounted to said handle for permitting said slidable collar means to move between said first and said second positions.

BRIEF DESCRIPTION OF THE DRAWINGS

For a more complete understanding of the present invention, reference may be had to the following description of exemplary embodiments of the present invention considered in connection with the accompanying drawings, of which.

DETAILED DESCRIPTION OF THE PREFERRED EMBODIMENTS

Figure 1:
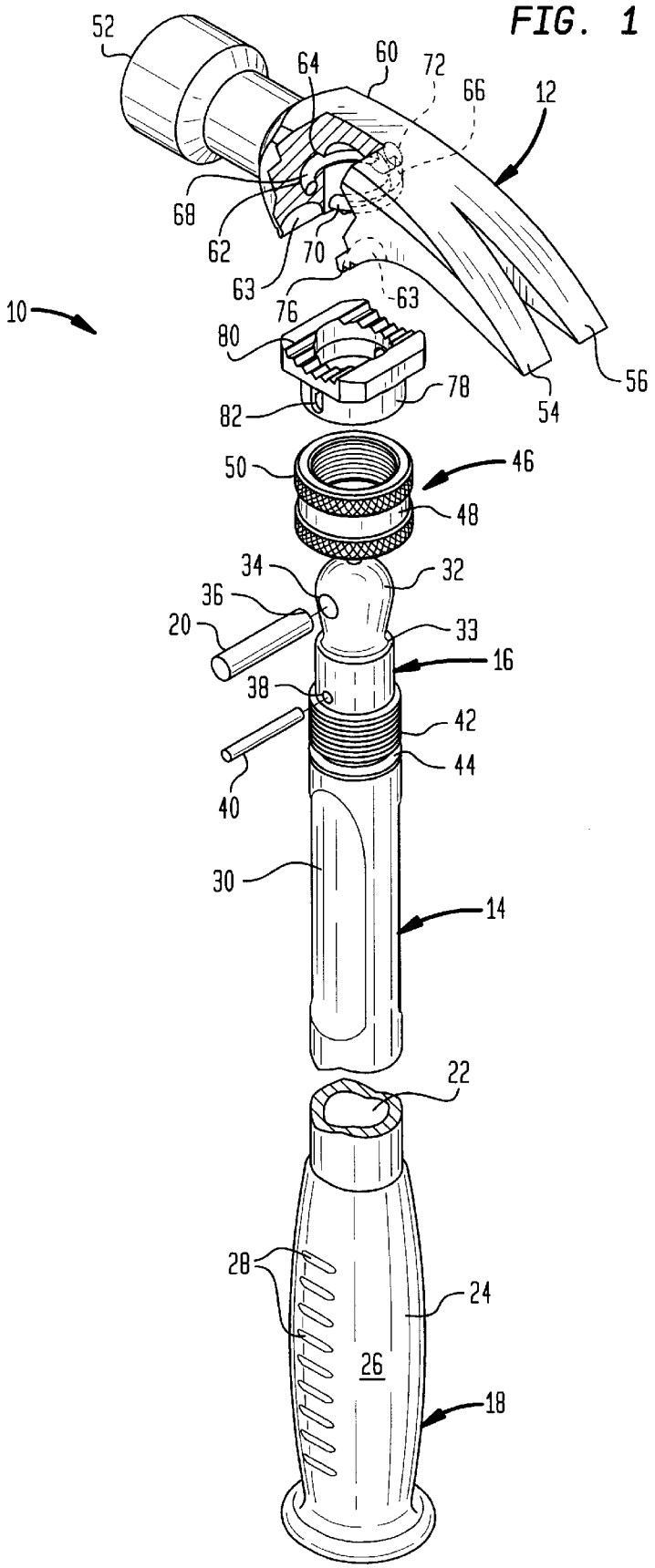
FIG. 1 is a fragmented, perspective view of a hammer having an improved adjustable head portion according to the present invention.
Figure 2:
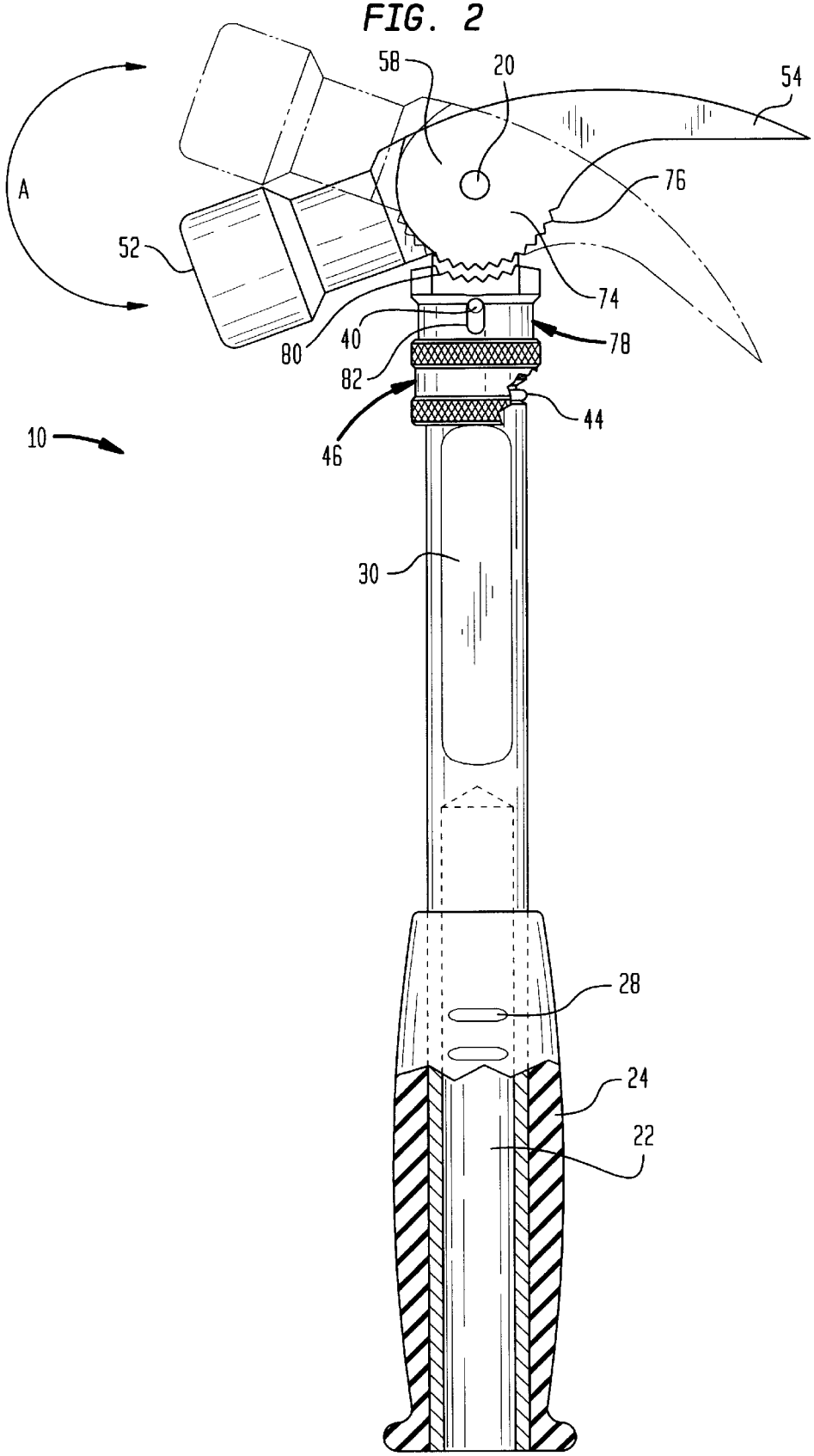
FIG. 2 is a partial cross-sectional exploded view of the hammer shown in FIG. 1, with the adjustability of the head portion being illustrated.
Figure 3:
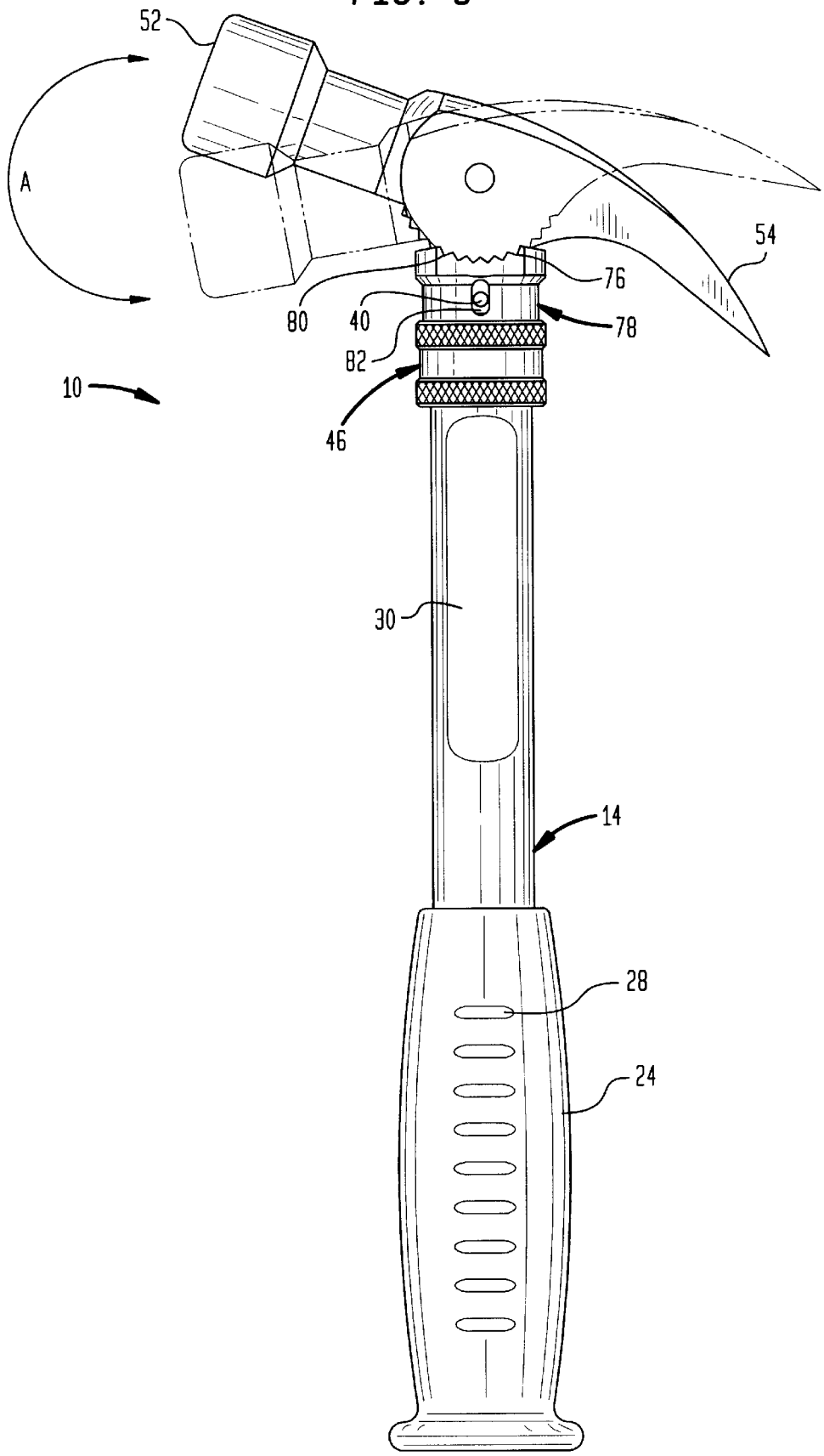
FIG. 3 is an elevational view of the hammer in FIG. 2 showing the head portion secured at a selected angle.

Referring to FIGS. 1–3, a tool with an improved head according to the present invention is shown generally at 10. Although the improved head is shown as a hammer 12, it is understood that this is by way of example only and the head may be of other constructions, such as a prybar discussed below. The head 12 is connected to a handle 14 having opposed ends 16,18. A pin 20 connects the head 12 to the end 16 of the handle 14.

Arrow A indicates the pivotal movement of the head portion for all the embodiments discussed below.

A bore 22 is formed in the handle 14 at the end 18, which bore extends partially into an interior of the handle 14. The bore 22 is open-ended and sized and shaped to receive an elongated object (not shown). A length of the handle 14 is therefore used to provide for greater mechanical purchase on an object, i.e. the handle 14 can function as what is referred to as a "cheater bar".

A sleeve 24 or grip extends over the end 18 of the handle 14. An exterior surface 26 of the grip 24 is formed with a plurality of indentations 28 to facilitate gripping the handle 14 as shown for example in FIG. 1. The indentations 28 are formed at opposed sides of the grip 24. The arrangement of the indentations 28 is shown by way of example only, and it is understood that other patterns or arrangements of the indentations 28 along the surface 26 of the grip 24 can be employed for the particular grip selected.

The handle 14 tapers from a point where it extends from the grip 24 toward the end 16 of the handle. The taper 30 provides a slight amount of flexibility in the handle 14. The tapered portion also provides for increased balance of the hammer, "give" when the head 12 strikes an object, and permits the head 12 to move about the handle 14 as discussed below.

The end 16 of the handle 14 tapers to a reduced diameter by milling or otherwise into a spherical shaped portion 32 resembling a ball. A portion 33 of the handle where the ball 32 joins the handle has a reduced diameter as shown for example in FIG. 1. The ball 32 has a smooth exterior surface about which the head 12 easily pivots, as discussed below. A bore 34 extends through the ball 32 to receive the pin 20. The pin 20 is preferably knurled 36 at least at one end for being press fit into the head 12. Another bore 38 is also formed in the handle 14 to receive a guide pin 40 which extends at opposed sides of the handle 14 as shown for a purpose to be described hereinafter with respect to FIGS. 2 and 3.

The surface of the handle below the bore 38 is threaded at 42. A seal 44 such as an O-ring is disposed concentrically about the threads.

A locking collar 46 is threadably engaged to the handle 14 at the threads 42. An interior portion of the locking collar 46 is constructed to retain the O-ring 44. The O-ring 44 provides resistance to the locking collar 46 when the collar is turned along the threads. An exterior surface 48 of the locking collar 46 is knurled at 50 to facilitate gripping and movement of the collar 42 along the threads of the handle 12.

The head 12 is formed with a striking surface 52 or butt portion and a pair of claws 54,56 which extend from the head 12 at an opposite side to the striking surface 52. The claws 54,56 are relatively short to coact with the adjustable head 12 for use in confined spaces. The intended striking surface of the butt portion is coaxial with a line drawn perpendicular to the striking surface for reducing the moments which occur on the pin 20 during impact of the butt portion.

Sides 58,60 of the head 12 are substantially flat and smooth so that the head 12 can be swung sideways to employ the sides 58,60 to strike objects.

An interior region of the head 12 is constructed as a concavity 62 which extends into the head to receive the ball 32. A pair of opposed arcuate channels 64,66 or grooves are formed in the head at opposed sides of the concavity 62 and in communication with the concavity as shown in FIG. 1. A pair of arcuate shaped shock absorbing members 68,70 are each disposed in a corresponding one of the grooves 64,66. The members 68,70 extend from their corresponding channels 64,66 to contact the exterior surface of the ball 32 to provide a dampening effect when the head 12 is pivoted about the ball 32. The dampening effect reduces vibrations and provides for a solid feel when the head 12 strikes an object.

The interior region of the head 12 is also formed with opposed shelf portions 63 (one of which is shown in broken lines due to the perspective of drawing FIG. 1). The shelf portions 63 are formed at opposed sides of the concavity 62 where the concavity extends into the head 12. The shelf portions 63 coact with the portion 33 of the handle having a reduced diameter to restrict the range of arc through which the head 12 will pivot on the ball 32. In effect, the pair of shelf portions 63 at opposed sides of the concavity 62 function as "stops". The travel of the head 12 along the ball 32 is restricted when the head 12 has traveled around the ball to a distance where one of the pair of shelf portions 63 contacts the handle at the portion 33 having the reduced diameter, such that the head 12 is prevented from traveling further around the ball 32. This "stopping" effect is implemented regardless of which direction the head is traveling along the arc represented by the arrow A.

An aperture 72 extends through the head 12 transverse to a longitudinal axis of the head. The aperture 72 is sized and shaped to receive the pin 20 to pivotally connect the head 12 to the ball 32 of the handle 14. Opposed ends of the pin 20 are constructed and arranged to lie flush with the sides 58,60 of the head 12, as shown in FIGS. 2 and 3, and see also FIG. 7.

A portion 74 of the head 12 intermediate the striking surface 52 and the claws 54,56 is constructed and arranged with an arcuate contour from which extend a plurality or set of teeth 76. The arrangement of the teeth 76 resembles a rack having a convex shape.

A positioning collar 78 is movably mounted to the handle 14 at the threads 42. The positioning collar 78 is also formed with a set of teeth 80, or rack of teeth, for releasable mating engagement with the rack of teeth 76 of the head 12. The rack of teeth 80 has a concave shape into which the convex shape of the rack 76 is seated. The shapes of the racks 76,80 permit the head to be pivoted to the desired angle for being secured at such angle. A slot 82 or keyway is formed in the positioning collar 78 to receive the guide pin 40 which extends from the handle 14. The slot 82 extends at opposed sides of the positioning collar (FIG. 1) for registration with the guide pin 40. The coaction of the guide pin 40 and the slot 82 permits the positioning collar 78 to move along a longitudinal axis of the handle 14 so that the teeth 76,80 remain in registration to releasably engage each other regardless of the angle that the head 12 makes with the handle 14 (see FIGS. 2 and 3). When the teeth 76,80 are releasably engaged, the head 12 will not move relative to the positioning collar 78 and the handle 14.

In operation, the user determines the angle at which the head 12 should be arranged with respect to the handle 14 to accomplish an accurate and effective swing. The locking collar 46 is backed off along the threads 42 so that the teeth 80 of the positioning collar 78 can be released from engagement with the teeth 76 of the head 12 (FIG. 2). The head 12 is then pivoted on the ball 32 to the desired angle with respect to the handle 14, afterwhich the positioning collar 78 is moved (threaded) toward the head 12 to bring the teeth 80 into engagement with the teeth 76 of the head 12. The locking collar 46 is then tightened up along the threads to abut against the positioning collar 78 and retain the teeth 76,80 in secure releasable engagement with each other (FIG. 3). The O-ring 44 resists the effects of shock which would otherwise cause the locking collar 46 to back-off along the threads 42 during the operation. This would permit the positioning collar 78 to come out of engagement with the head 12 and the head to pivot uncontrollably.

The ability to vary the angle of the head 12 provides for many advantages. One such advantage is compensation for the natural angle of movement of the hand. Normally, the hand has an angle which tends to place the handle 14 in a non-parallel position when striking a vertical surface. The handle 14 itself would not be vertical, but would tend to be about 10° to 15° forward. By moving the striking surface of the head 12 above the horizontal, the angle can be compensated for so that the head will strike flush against a horizontal surface with the hand below the head.

When hammering on a horizontal surface, the head 12 would be placed above the horizontal, above the perpendicular to the handle 14, or possibly at the perpendicular to the handle depending upon the location of the work piece.

When the claws 54,56 of the hammer are used for prying or for leverage, a greater purchase can be obtained by lowering the striking surface 52 below the perpendicular which would move the handle 14 away from the vertical surface that is being dislodged to give more clearance for pulling on or prying an object.

The sides 58,60 of the head 12 are flat to allow for side hammering. Because the pin 20 through the ball 32 is positioned at the center of the strike line, or intersecting and perpendicular to the strike line of the head 12, there will be little if no moment produced on the pin 20 during striking. Since there is a negligible moment produced, the stress on the racks 76,80 formed by the coacting surfaces between the head 12 and the positioning collar 78 is minimal, which therefore extends the durability of the racks.

The adjustability of the head 12 permits the striking surface 52 to be adjusted flush with the surface being struck or perpendicular to the line of strike. Therefore, a swing along a true arc can be obtained, rather than a combination of arc and translation, known as a "push", which is often used in order to obtain the perpendicular relation of the striking surface 52 with the object being struck.

The tool 10 allows for greater accuracy and less fatigue, since motion is occurring from the elbow with the forearm, rather than with the shoulder and the back as is necessary when a push is produced. The body is exposed to less trauma since there is no resistance being felt by the arm during a true swing. The striking occurs at the center of percussion, or "sweet spot", and the weight of the hammer is also used more advantageously, thereby producing greater mechanical advantage, greater efficiency of striking energy, reduced trauma and fatigue to the user, and greater accuracy in the swing. A lighter hammer can therefore do the job of a hammer that is much heavier, thereby further reducing the fatigue and trauma factors.

Figure 4:
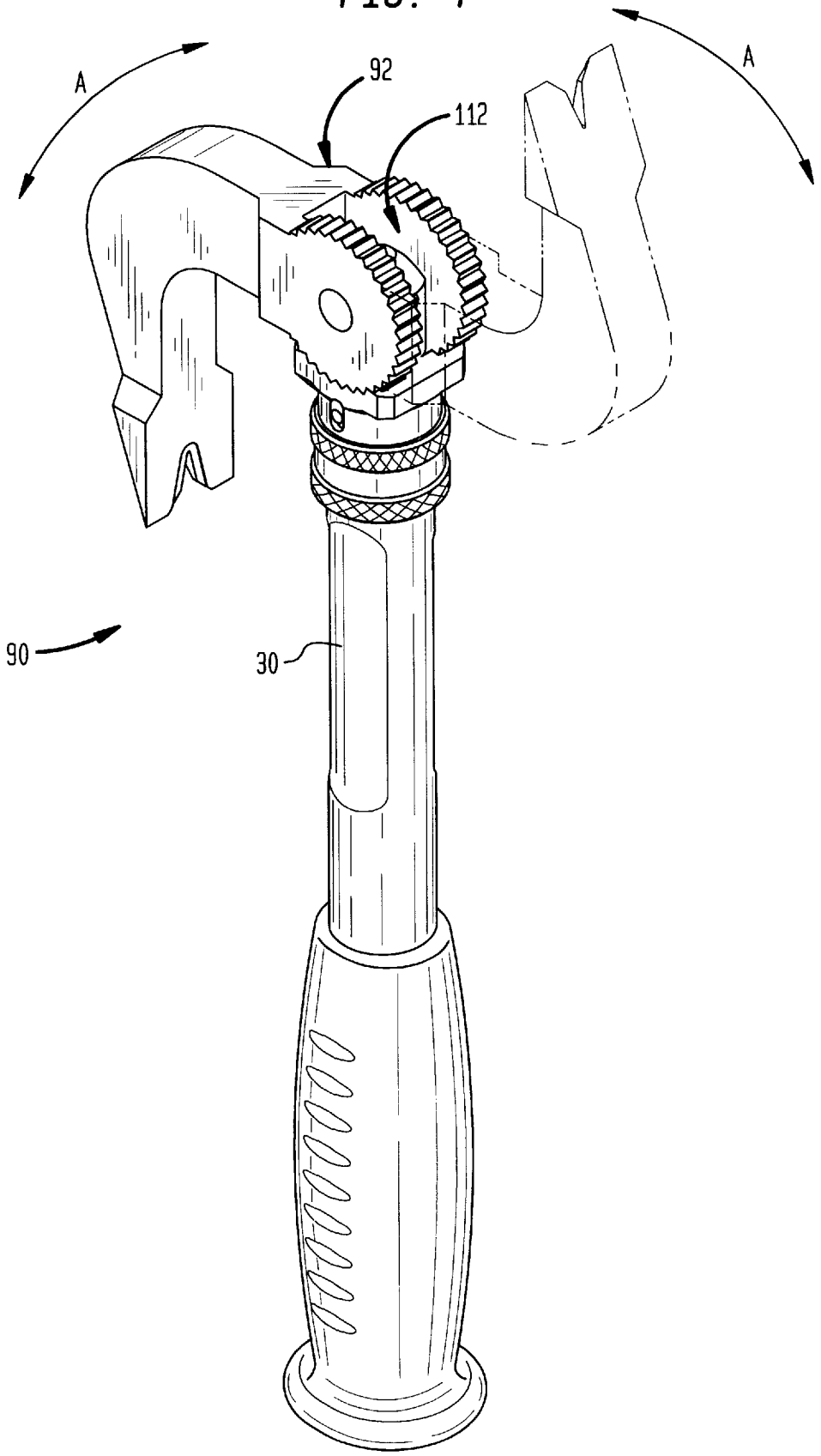
FIG. 4 is a view of another embodiment of the tool of the present invention having an adjustable pry bar head.
Figure 5:
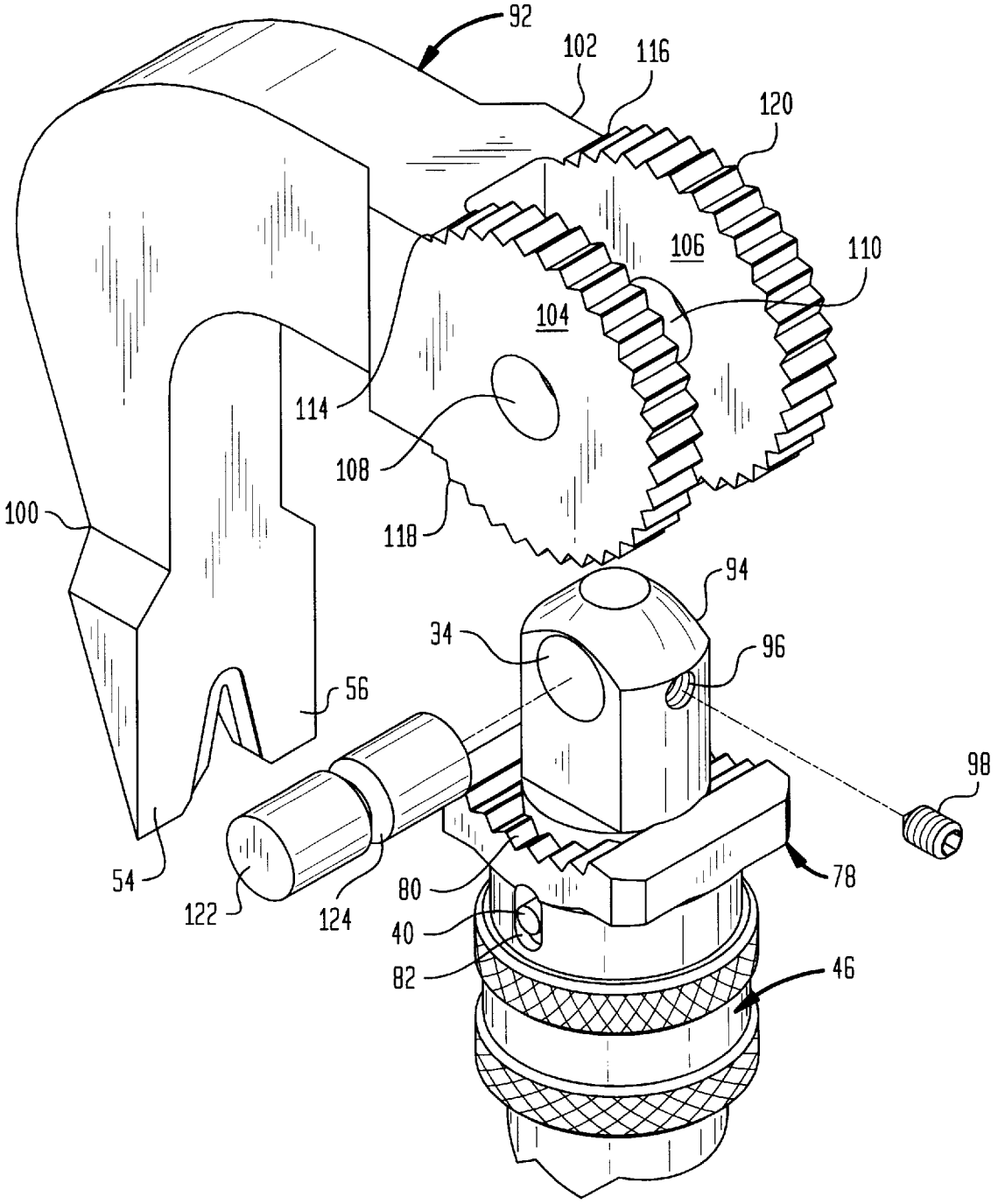
FIG. 5 is an exploded view of the pry bar head shown in FIG. 4.

FIGS. 4 and 5 show another embodiment of the tool according to the present invention. In FIGS. 4 and 5, a prybar tool 90 is provided with the head portion 92 shaped as a prybar, crowbar or the like. Elements shown in FIGS. 4 and 5, which correspond to the elements shown and discussed above with respect to FIGS. 1–3 have been designated by the same reference numerals. The embodiment of FIG. 4 and 5 is constructed with the same features for use in the same manner as the embodiment of FIGS. 1–3 unless otherwise stated.

Referring to FIGS. 4 and 5, an end 16 of the handle 14 for the prybar tool is provided with a tongue 94 or column, instead of a ball shape member, to which the prybar head 92 is pivotally mounted. The tongue 94 is formed with a bore 34 extending therethrough. A secondary, smaller aperture 96 is also formed in the tongue 94 perpendicular to the bore 34. The secondary aperture 96 is in communication with the bore 34, but does not extend all the way through the tongue 94, and is threaded to receive a threaded retaining pin 98.

One end 100 of the prybar head 92 is formed with claws 54,56. An opposite end 102 of the prybar head 92 is bifurcated into two separate and discrete disc-like members 104,106. The disc-like members 104,106 are spaced apart and parallel, and are each provided with a corresponding aperture 108,110 therethrough. The apertures 108,110 are in registration with each other. A space 112 between the discs 104,106 is sized and shaped to receive the tongue 94 of the handle 14. When the tongue 94 is disposed in the space 112 between the discs 104,106, the bore 34 in the tongue 94 is in registration with the apertures 108,110 of the discs 104,106.

A peripheral edge 114,116 along an exterior surface of each one of the discs 104,106 is formed with a plurality of teeth 118,120 which are constructed and arranged to releasably engage the corresponding teeth 80 of the positioning collar 78 at opposed sides of the tongue 94.

A mounting pin 122 is sized and shaped to extend through the apertures 108,110 of the discs 104,106 and the bore 34 of the tongue 94 to pivotally mount the prybar head 92 to the handle 14. A groove 124 extends circumferentially around the mounting pin 122. When the pin 122 is mounted to hold the prybar head 92 to the tongue 94, the retaining pin 98 is threaded through the aperture 96 to extend into the groove 124 of the pin 122 and thereby prevent the pin 122 and the head 92 from being displaced from the tongue 94. The length of the mounting pin 122 is such that opposed surfaces of the pin 122 remain flush with exterior surfaces 126,128 of the discs 104,106 as shown in FIG. 4.

Operation of this embodiment is similar to that of the embodiment shown in FIGS. 1–3.

In operation, the locking collar 46 is turned to move laterally along the handle 14. The positioning collar 78 is controlled by the keyway 82 and guide pin 40 arrangement, similar to that discussed in connection with FIGS. 1–3. This causes the teeth 80 on the positioning collar 78 to engage the teeth 118,120 of the discs 104,106 and thereby position the head 92 securely at a desired angle with respect to the longitudinal axis of the handle 14. The retaining pin 98 does not have to be adjusted when the prybar head 92 is being pivoted or secured into the selected angular position.

Figure 6:
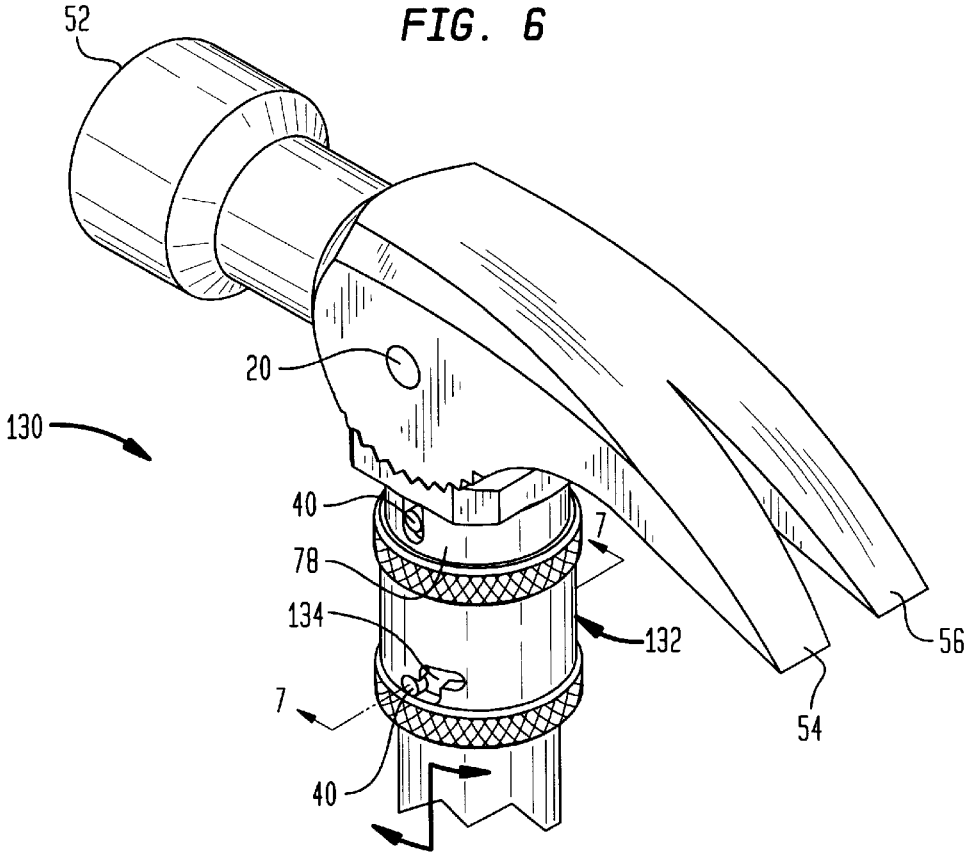
FIG. 6 is a view of still another embodiment of the present invention having a quick-release bayonet coupling for the head portion and the shaft of the tool.
Figure 7:
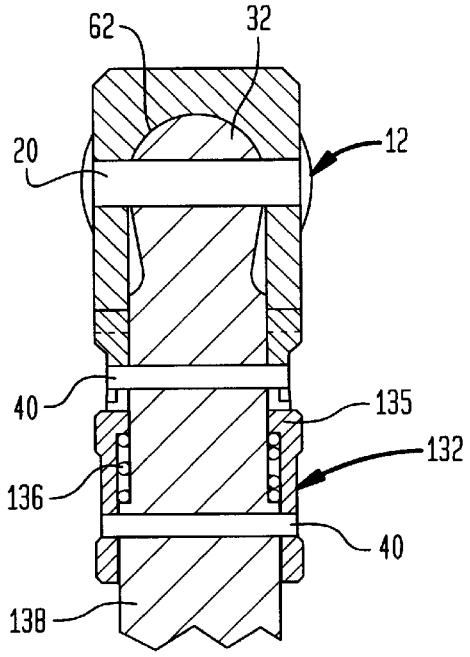
FIG. 7 is a cross-sectional view taking along line 7—7 in FIG. 6.

In FIGS. 6 and 7, still another embodiment of the present invention is shown. Elements shown in FIGS. 6 and 7 which correspond to the elements described above with respect to FIGS. 13 have been designated by the same reference numerals. The embodiment shown in FIGS. 6 and 7 is constructed with the same features for use in the same manner as the embodiment of FIGS. 1–3 unless otherwise stated.

In this embodiment, the tool 130 includes a locking collar 132 as a quick-release bayonet mounting which can be a conventional spring-based assembly. The locking collar 132 is formed with an S-shaped keyway 135 into which the guide pin 40 is disposed. The locking collar 132 is also provided with a flange portion 134 which extends around an uppermost portion of the locking collar. A spring 136 is mounted to a handle 138 of the tool 130 and retained on the handle 138 between the flange 135 and the guide pin 40, such as shown in FIG. 7. The spring 136 is biased against the flange 135 of the locking collar 132 to force the locking collar against the positioning collar 78 to hold the hammer head 12 at a desired angle with respect to the handle 138.

In operation, with the hammer head 12 already secured at the designed angle as shown in FIG. 6, the locking collar 132 is turned to move the keyway 134 along the guide pin 40 to a vertical portion of the keyway. The locking collar 132 is then retracted away from the head 12 so that the teeth 76,80 disengage. The head 12 is then pivoted to the desired angle, afterwhich the locking collar 132 is once again turned to secure the positioning collar 78 against the head 12 to releasably engage the respective sets of teeth 76,80.

This locking collar assembly 132 can be used with the embodiment of FIGS. 4 and 5, although such assembly is preferably used with the embodiment shown in FIGS. 1–3.

It will be understood that the embodiments described herein are merely exemplary and that a person skilled in the art may make many variations and modifications without departing from the spirit and scope of the invention. All such variations and modifications are intended to be included in the scope of the invention as described herein and defined in the appended claims.

What is claimed is:

1. A hand tool comprising:

a head comprising:

a butt portion having an intended striking surface being coaxial with a line perpendicular to the striking surface for striking an object;

a pair of claws spaced apart for gripping the object;

a convex portion disposed between the butt portion and the pair of claws, the convex portion having a first set of teeth formed thereon;

a concavity extending to an interior of said head between the butt portion and the pair of claws, and having a substantially spherical shape;

a pair of arcuate grooves separate and discrete from each other formed at opposed sides of the concavity;

a pair of cushioning elements, each one of said pair of cushioning elements being disposed in a respective one of said pair of grooves and extending therefrom into said concavity;

a pair of shelf portions formed in said head at opposed sides of said concavity and adjacent to said concavity;

a handle comprising:

a first end and a second end opposed to said first end;

a ball shape formed at said first end and constructed for being disposed in the concavity of said head;

a first portion having a diameter less than a diameter of said ball and said handle, said first portion arranged at said first end where said ball shape joins said handle, wherein said first portion and said pair of shelf portions coact to permit the head to pivot with respect to the handle through a range of arc;

a mounting pin connecting the head with the ball shape, the mounting pin disposed in said head intersecting a line drawn perpendicularly from the center of the striking surface of the butt portion to eliminate moments produced by blows to the striking surface;

a guide pin extending from opposed sides of the first end of said handle;

means for positioning said head at a select angle with respect to said handle, said positioning means comprising:

a first collar mounted to said first end of said handle in proximity to said ball shape, said first collar having a concave portion with a second set of teeth for cooperative releasable engagement with said first set of teeth along said convex portion of said head, and movable between a first position where said first and second sets of teeth are spaced apart for pivoting said head to a select position, and a second position where said first and second sets of teeth releasably engage each other for securing said head at the select angle with respect to said handle;

a cutout in said first collar for receiving said guide pin for controlling movement of said first collar along said handle;

means for securing said positioning means, comprising:

a second collar movably mounted to said handle for coacting with said first collar to secure said first collar between said first and second positions;

an O-ring mounted around said handle beneath said second collar for maintaining said second collar at a select position on said handle;

grip means surrounding said handle at said second end; and a bore in said handle extending from said second end into said handle for receiving an extension for said handle; wherein movement of said second collar from said first position to said second position disposes said second set of teeth of said securing means to releasably engage said first set of teeth of said head to coact and secure said head at a select angular position on said ball with respect to the handle.

2. A hand tool comprising:

a tool head, including:

a rounded concavity extending to an interior of said tool head, a pair of arcuate grooves separate and discrete from each other formed at opposed sides of the concavity, a pair of cushioning elements, each one of said pair of cushioning elements being disposed in a respective one of said pair of grooves and extending therefrom into said concavity, a pair of shelf portions formed in said tool head at opposed sides of said concavity and adjacent to said concavity;

a first pair of spaced arcuate toothed first fixing means extending from said tool head;

a handle, said handle having a rounded end portion receivable in said rounded concavity of said tool head such that the tool head pivots about the rounded end portion of said handle to a select angular position, said shelf portions of said tool head coacting with a portion of said handle adjacent to said rounded end portion to limit an arc of travel of the tool head over the rounded end portion of the handle;

a securing pin connecting said tool head with said handle;

a first collar having a second pair of spaced arcuate toothed fixing means mounted to said handle, said second pair of arcuate fixing means constructed for coaction with said first arcuate fixing means; and a second collar rotatably mounted to the handle and movable into and out of contact with said first collar for said first fixing means and said first collar to coact and secure the tool head at a select angle with respect to the handle.

3. The hand tool according to claim 2, wherein the portion of said handle adjacent to said rounded end portion is constructed with a diameter less than a diameter of the rounded end portion.

4. The hand tool according to claim 2, further comprising:

a guide pin extending from said handle for coaction with said first collar such that said first collar is in registration for coaction with said first fixing means.

5. The hand tool according to claim 2, wherein said securing pin is disposed in said tool head to intersect a line drawn perpendicular from a center of a striking surface of the tool head to eliminate moments induced by blows to the striking surface.

6. The hand tool according to claim 2, further comprising:

an O-ring mounted to said handle beneath said first collar for maintaining said first collar at a select position on said handle.

7. The hand tool according to claim 2, further comprising:

a bore extending into the handle at an end of the handle opposite to the tool head.

8. The hand tool according to claim 2, where the first fixing means comprises:

a pair of discs spaced apart and extending from a first end of said tool head, and a set of teeth formed along each one of said pair of discs.

9. The hand tool according to claim 8, wherein:

the rounded end portion of said handle is constructed for being dispose in a space between said pair of discs for the tool head to pivot about the rounded end portion of said handle to a select angular position.

10. The hand tool according to claim 8, further comprising:

a pair of shelf portions formed in said head at opposed sides of said space at a position where a respective one of the pair of discs is connected to said first end of said tool head wherein said shelf portions of said tool head coact with said first collar to regulate an arc of travel of the tool head over the tongue.

11. The hand tool according to claim 10, further comprising:

a guide pin extending from said handle for coaction with said first collar such that first collar is in registration with said first fixing means.

12. The hand tool according to claim 11, wherein said second fixing means comprises:

a concave portion, a second set of teeth disposed along the concave portion for cooperative releasable engagement with said plurality of teeth of said pair of discs.

13. The hand tool according to claim 12 wherein said second collar is movably mounted to said handle for coacting with said first collar to secure said first collar in a select angular position.

14. The hand tool according to claim 13, further comprising:

an O-ring mounted to said handle beneath said first collar for maintaining said first collar at a select position on said handle.

15. The hand tool according to claim 14, further comprising:

a bore extending into the handle at an end of the handle opposite to the tool head.

16. The hand tool according to claim 2, wherein the head portion is a hammer.

17. The hand tool according to claim 2, wherein the head portion is a prybar.

18. The hand tool according to claim 2, wherein the second collar is threadably mounted to the handle.

19. A hand tool, comprising:

a head comprising:

a first end and a second end opposed to said first end;

a pair of claws at said first end spaced apart for gripping an object;

a pair of discs spaced apart at said second end of said head, each one of said pair of discs having a plurality of teeth formed along a peripheral edge thereof, and a corresponding aperture extending therethrough;

a pair of shelf portions each one of said shelf portions formed at said second end of said head where a respective one of said discs is joined to said second end, a handle comprising:

a first end and a second end opposed to said first end;

a tongue formed at said first end and constructed for being disposed in the space between the pair of discs;

a first mounting aperture formed in said tongue;

a second mounting aperture formed in said tongue and in communication with said first mounting aperture;

a mounting pin connecting the head with the tongue, the mounting pin formed with a groove and disposed in said first mounting aperture to pivotally connect the head with the tongue;

a first guide pin constructed to extend through said second mounting aperture into the groove on said mounting pin;

a second guide pin extending from opposed sides of the first end of said handle;

means for positioning said head at a select angle with respect to said handle, said positioning means comprising:

a first collar mounted to said first end of said handle in proximity to said tongue, said first collar having a concave portion with a second set of teeth for cooperative releasable engagement with said first set of teeth along said convex portion of said head, and movable between a first position where said first and second sets of teeth are spaced apart for pivoting said head to a select position, and a second position where said first and second sets of teeth releasably engage each other for securing said head at the select angle with respect to said handle;

a cutout in said first collar for receiving said second guide pin for controlling movement of said first collar along said handle;

means for securing said positioning means, comprising:

a second collar movably mounted to said handle for coacting with said first collar to secure said first collar between said first and second positions;

an O-ring mounted around said handle beneath said second collar for maintaining said second collar at a select position on said handle;

grip means surrounding said handle at said second end; and a bore in said handle extending from said second end into said handle for receiving an extension for said handle;

wherein movement of said second collar from said first position to said second position disposes said second set of teeth of said securing means to releasably engage said first set of teeth of said head to coact and secure said head at a select angular position on said tongue with respect to the handle.

* * * * *